US007774899B2

(12) United States Patent
Braunlich

(10) Patent No.: US 7,774,899 B2
(45) Date of Patent: Aug. 17, 2010

(54) NON-HANDED DOOR CLOSER COVER ATTACHMENT METHOD

(75) Inventor: Mark Frederick Braunlich, Princeton, IL (US)

(73) Assignee: Schlage Lock Company, Carmel, IN (US)

( * ) Notice: Subject to any disclaimer, the term of this patent is extended or adjusted under 35 U.S.C. 154(b) by 306 days.

(21) Appl. No.: 12/092,219

(22) PCT Filed: Nov. 3, 2006

(86) PCT No.: PCT/US2006/060542

§ 371 (c)(1),
(2), (4) Date: Apr. 30, 2008

(87) PCT Pub. No.: WO2007/056702

PCT Pub. Date: May 18, 2007

(65) Prior Publication Data

US 2008/0229540 A1 Sep. 25, 2008

Related U.S. Application Data

(60) Provisional application No. 60/738,018, filed on Nov. 3, 2005.

(51) Int. Cl.
*E05F 3/22* (2006.01)

(52) U.S. Cl. ..... 16/52; 16/71; 16/49

(58) Field of Classification Search ..... 16/52, 16/71, 49, 58, 51, 66, 79; 292/92, 306, 339, 292/275, DIG. 25; 49/324
See application file for complete search history.

(56) References Cited

U.S. PATENT DOCUMENTS 510,468 A 12/1893 Buehl (Continued)

FOREIGN PATENT DOCUMENTS

EP 730077 9/1996

(Continued)

OTHER PUBLICATIONS

Mark F. Braunlich, Senior Design Engineer and Inventor, Non-handed Door Closer Cover Attachment Methods, 10 pages.
PCT/US06/60542 International Search Report and Written Opinion mailed Aug. 14, 2008, 7 pages.

*Primary Examiner*—Chuck Y. Mah
(74) *Attorney, Agent, or Firm*—Michael Best & Friedrich LLP

(57) ABSTRACT

A cover for either a left-handed or right-handed operating automatic door closer including a body, and a pinion shaft extending from the top of the body, the cover comprising: a housing including a wall and an open rear, the wall having a rear edge and having therein first and second slots, each of the slots extending forward from the rear edge; and a clip including a base complementary to each of the first and second slots, and a flexible hook including a first end connected to the base and a floating second end, the base of the clip being insertable into either one of the slots so that the base substantially fills the one of the slots and the clip is secured to the wall of the housing with the hook positioned inside the housing and opening rearwardly; the housing with the clip inserted into one of the slots being positionable over the door closer with the hook of the clip receiving the door closer; wherein, when the housing is positioned over the door closer, the pinion shaft extends through the first slot and the clip is inserted in the second slot when the door closer is configured for left-handed operation, and the pinion shaft extends through the second slot and the clip is inserted in the first slot when the door closer is configured for right-handed operation.

24 Claims, 4 Drawing Sheets

U.S. PATENT DOCUMENTS

| | | | |
|---|---|---|---|
| 3,216,685 | A | 11/1965 | Raymond |
| 4,231,134 | A | 11/1980 | Schoker |
| 5,477,589 | A | 12/1995 | Lan |
| 5,946,772 | A | 9/1999 | DeBower |
| 6,125,505 | A | 10/2000 | Jensen et al. |
| 6,260,236 | B1 | 7/2001 | Toledo |
| 6,298,520 | B1 | 10/2001 | Blickhahn et al. |

FOREIGN PATENT DOCUMENTS

| | | |
|---|---|---|
| GB | 2248877 | 4/1992 |
| GB | 2358888 | 8/2001 |
| WO | 2004007882 | 1/2004 |

NON-HANDED DOOR CLOSER COVER ATTACHMENT METHOD

RELATED APPLICATION

This application claims the benefit of Provisional Patent Application No. 60/738,018, filed on Nov. 3, 2005, the entire content of which is incorporated herein by reference.

BACKGROUND

The present invention relates to door closers, and particularly to non-handed door closers. A non-handed door closer is one that can be mounted to either right or left-hand swinging doors Non-handed closers normally consist of a cylinder (also called mechanism) and either a double arm set or a single arm set and a track. The cylinder has a shaft (also called pinion or pinion shaft) protruding from both the top and bottom of the cylinder body. Either one end or the other of this shaft is attached to the arm set depending on the hand of the door.

Many closers include a plastic or metal cover to improve the architectural esthetics of the cylinder. These covers either snap on (or "clip on") to the closer cylinders, or are attached with a number of screws. The latter are generally used on "institutional" applications (hospitals, schools, government buildings, etc.) to provide tamper resistance and theft resistance.

SUMMARY

In one embodiment, the invention provides a cover for either a left-handed or right-handed operating automatic door closer including a body, and a pinion shaft extending from the top of the body, the cover comprising: a housing including a wall and an open rear, the wall having a rear edge and having therein first and second slots, each of the slots extending forward from the rear edge; and a clip including a base complementary to each of the first and second slots, and a flexible hook including a first end connected to the base and a floating second end, the base of the clip being insertable into either one of the slots so that the base substantially fills the one of the slots and the clip is secured to the wall of the housing with the hook positioned inside the housing and opening rearwardly; the housing with the clip inserted into one of the slots being positionable over the door closer with the hook of the clip receiving the door closer; wherein, when the housing is positioned over the door closer, the pinion shaft extends through the first slot and the clip is inserted in the second slot when the door closer is configured for left-handed operation, and the pinion shaft extends through the second slot and the clip is inserted in the first slot when the door closer is configured for right-handed operation.

In another embodiment the invention provides a method of covering either a left-handed or right-handed operating automatic door closer including a body, and a pinion shaft extending from the top of the body, the method comprising: providing a cover housing including a wall and an open rear, the wall having a rear edge and having therein first and second slots, each of the slots extending forward from the rear edge; providing a clip including a base complementary to each of the first and second slots, and a flexible hook including connected to the base; inserting the base of the clip into the second slot if the door closer is configured for left-handed operation, so that the base substantially fills the second slot and the clip is secured to the wall of the housing with the hook positioned inside the housing and opening rearwardly; and after inserting the base of the clip into the second slot, placing the cover housing over the door closer so that the pinion shaft extends through the first slot and the hook of the clip grips the door closer; or inserting the base of the clip into the first slot if the door closer is configured for right-handed operation, so that the base substantially fills the first slot and the clip is secured to the wall of the housing with the hook positioned inside the housing and opening rearwardly; and after inserting the base of the clip into the first slot, placing the cover housing over the door closer so that the pinion shaft extends through the second slot and the hook of the clip grips the door closer.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
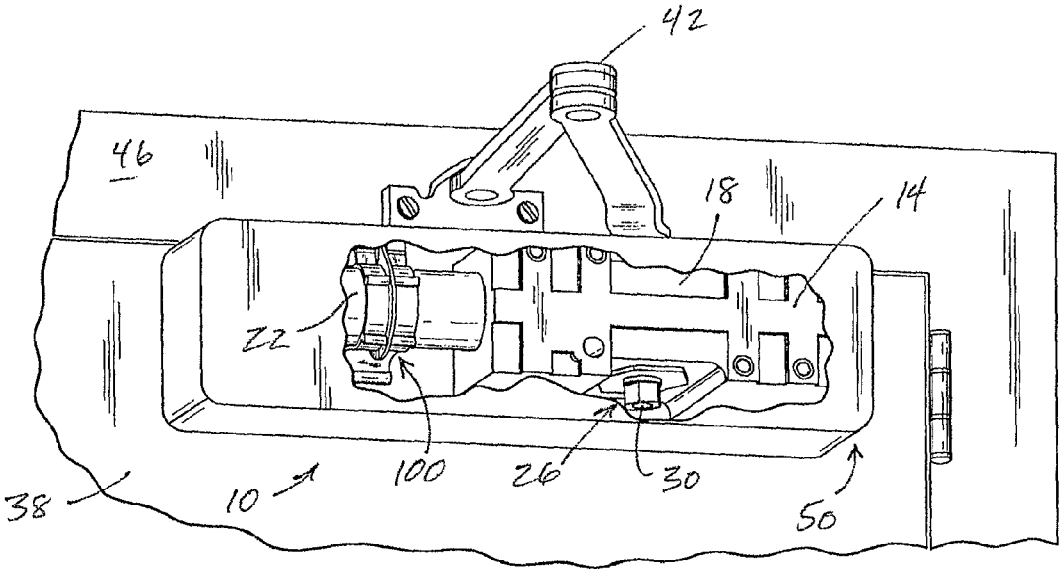
FIG. 1 is a perspective view, partially broken away, of a cover embodying the invention on a left-handed door closer.
Figure 2:
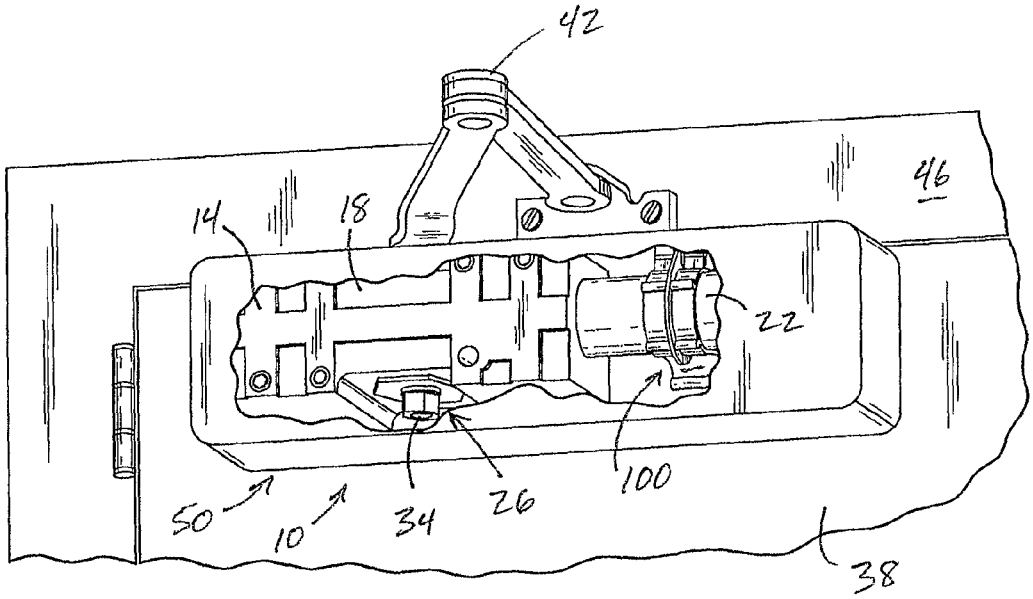
FIG. 2 is a perspective view, partially broken away, of a cover embodying the invention on a right-handed door closer.

A cover 10 for an automatic door closer 14 is illustrated in the drawings. The door closer 14 includes a cylinder body 18, and a cylindrical spring tube or cylinder 22 extending from the cylinder body. The door closer 14 also includes a pinion shaft 26 extending from the top and bottom surfaces of the cylinder body 18. One end 30 of the shaft 26 extends from what is the bottom surface when the cylinder body 18 is oriented in as shown in FIG. 1, and the other end 34 of the shalt 26 extends from what is the bottom surface when the cylinder body 18 is oriented in as shown in FIG. 2. The cylinder body is mounted on a door 38, and a double arm set 42 is connected between the pinion shaft 26 and the door frame 46. If the door closer 14 is mounted for left-handed operation, as shown in FIG. 1, the arm set 42 is connected to the end 34 of the shaft 26. If the door closer 14 is mounted for right-handed operation, is shown in FIG. 2, the arm set 42 is connected to the end 30 of the shaft 26. The door closer 14 as thus far described is known in the art and need not be described in greater detail.

Figure 3:
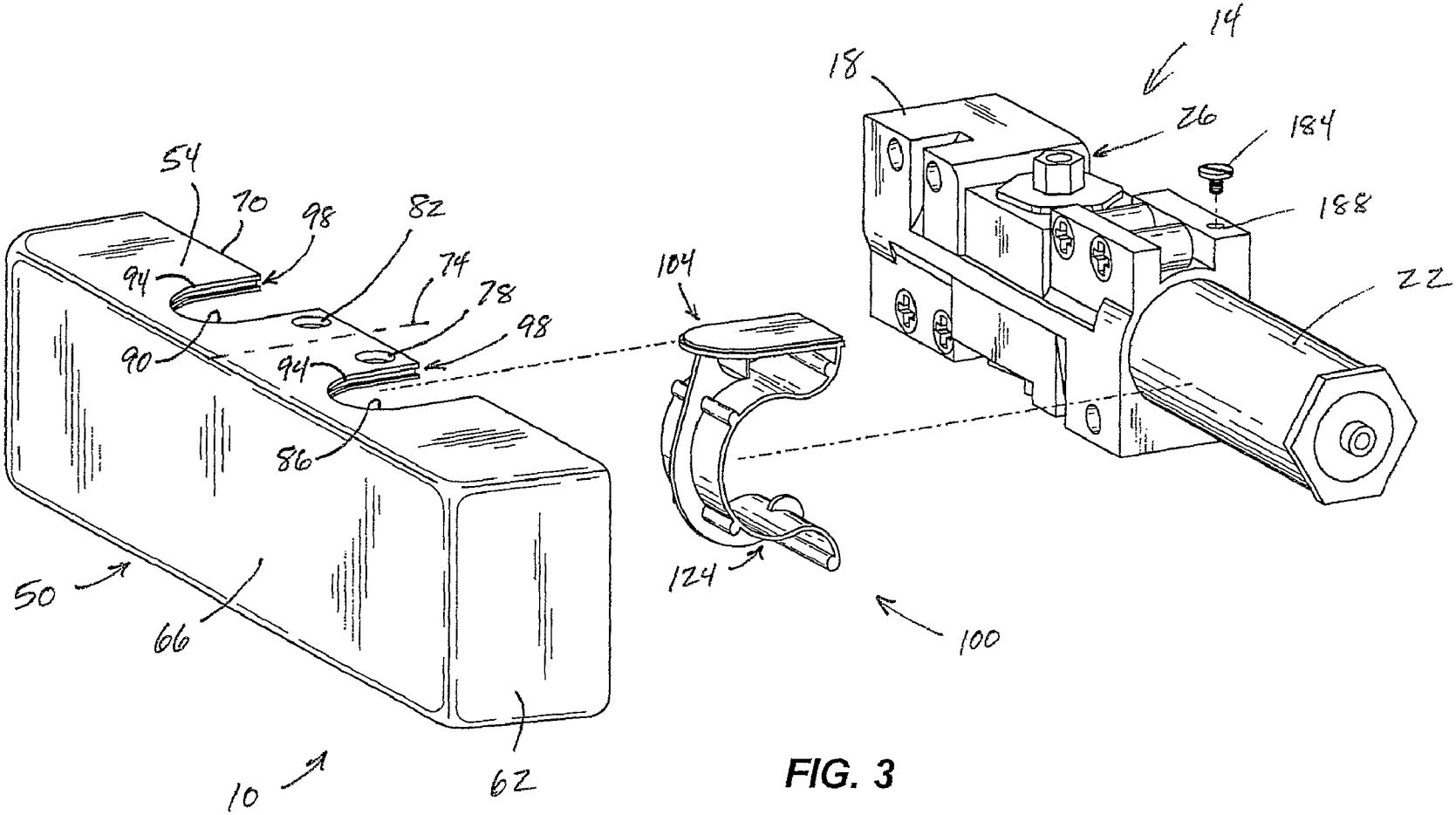
FIG. 3 is an exploded perspective view of the cover, clip and door closer body of FIG. 2.

The cover 10 comprises a generally rectangular housing 50 including a top wall 54, a bottom wall 58, opposite end walls 62 and a front wall 66. The walls 54, 58, 62 and 66 are all generally planar, with the top and bottom walls 54, 58 being generally parallel, the opposite end walls 62 extending between the top and bottom walls and being generally parallel, and the front wall 66 extending between and perpendicular to the top and bottom walls and between and perpendicular to the end walls. The housing 50 has (see FIGS. 6 and 7) an open rear, and the top wall 54 has a rear edge 70 and a front-to-rear centerline 74 (FIG. 3) and is generally symmetrical about the centerline 74.

The top wall 54 has therein (see FIG. 3) right and left or first and second screw apertures 78, 82 respectively located on opposite first and second or right and left sides of the centerline 74. The top wall 54 also has therein right and left or first and second slots 86, 90 respectively located on the right and left sides of the centerline 74 and outside of the screw apertures 78, 82 relative to the centerline 74. Each of the slots 86, 90 is generally U-shaped and extends forward from the rear edge 70 of the top wall 54. Each of the slots 86, 90 has a perimeter defined by a surface 94 of the top wall 54 having therein a single groove 98 extending along the perimeter of the slot 86 or 90. The housing 50 can be made of any suitable material, and is preferably made of plastic, such as GE Noryl PX5622, which also has fire resistant properties.

While the housing 50 has been described as having top and bottom walls and is shown only with the top wall 54 on top in the drawings, it should be understood that the door closer 14 could be mounted "upside down," with the door closer 14 on the door frame 46 and with the arm set 42 connected between the door 38 and the bottom of the door closer, in which case the housing 50 would be mounted on the door closer 14 with the top wall 54 on the bottom. Thus, the terms "top" and "bottom" should not be considered limiting.

Figure 5:
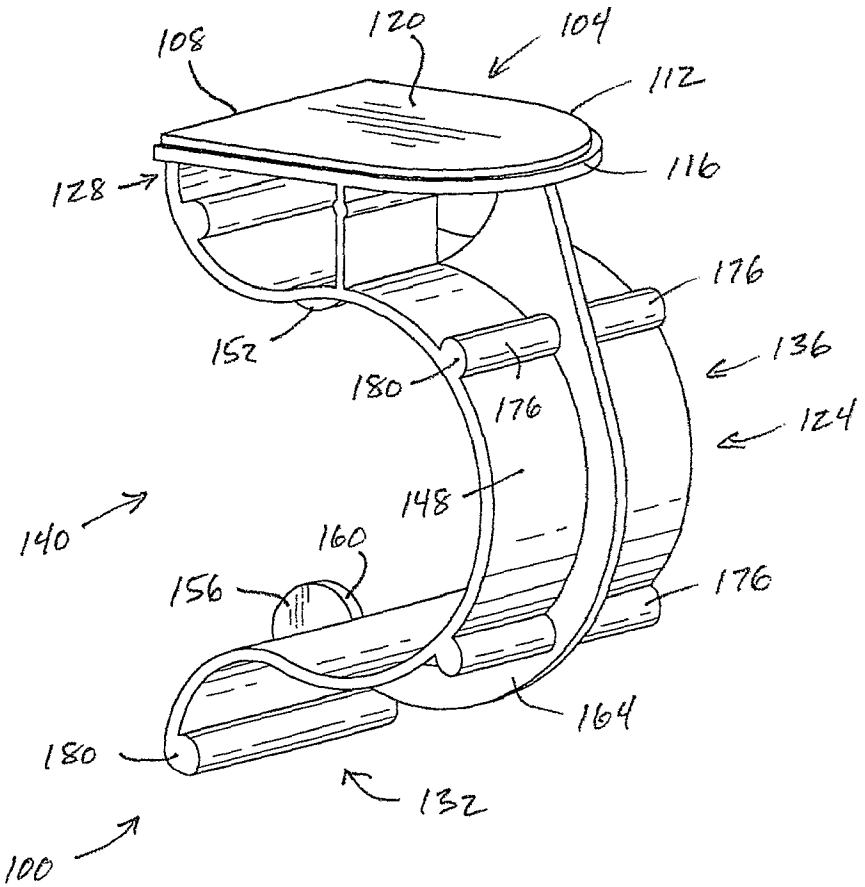
FIGS. 4 and 5 are perspective views of the clip.
Figure 4:
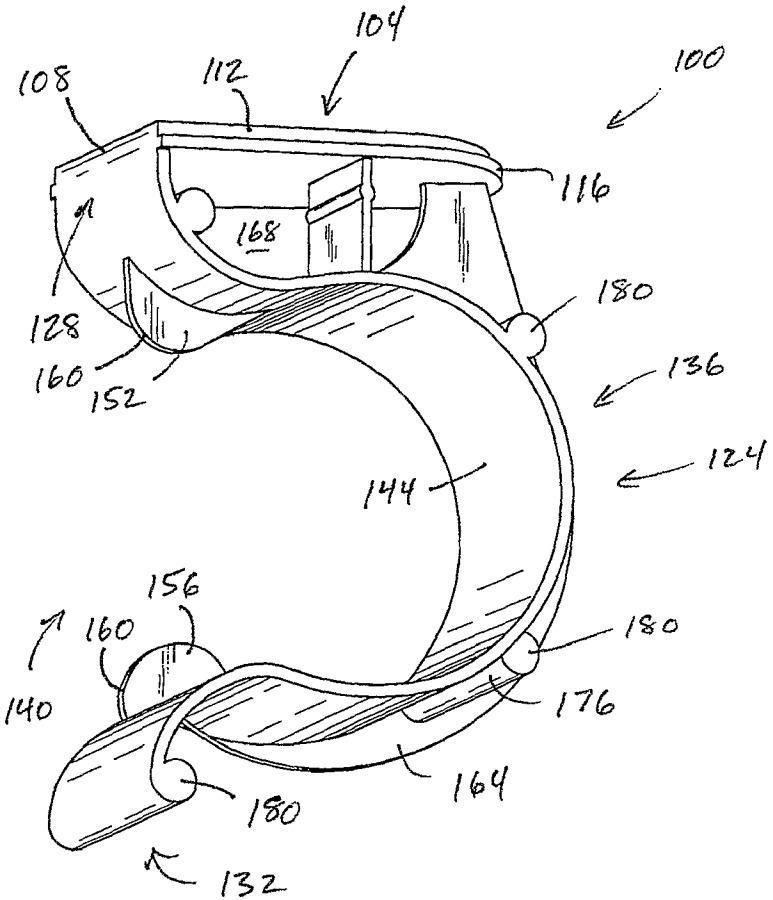

The cover 10 also comprises a unitary clip 100 that is preferably made of injection molded plastic. The plastic should be flexible, and any suitable plastic, such as GE Noryl PX5622, can be used. The clip 100 includes (see FIGS. 3-5) a generally planar, generally U-shaped base 104 complementary to each of the slots 86, 90. The base 104 has a rear 108 and a perimeter 112 and includes a protrusion or ridge 116 that extends along the perimeter and that is configured to mate with the groove 98 of a slot into which the base 104 is inserted. The base 104 also has a generally planar upper surface 120. The clip 100 also includes a flexible hook 124 including a first or upper end 128 connected to the rear end 108 of the base. The hook 124 also has a floating second or lower end 132, and a generally C-shaped intermediate section 136 between the ends of the hook 124, the intermediate section 136 having a rearward-facing opening 140. The hook 124 has a ribbon-like configuration with a rearwardly facing inner surface 144 and a forwardly facing outer surface 148. The inner surface 144 of the intermediate portion 136 generally forms a portion of a cylinder and has a diameter approximately equal to the outer diameter of the spring cylinder 22.

The clip 100 also includes upper and lower tongues 152, 156 extending inward from the intermediate section 136 of the hook adjacent the upper and lower ends, respectively, of the hook. The tongues 152, 156 are generally planar and extend generally perpendicular to the inner surface 144 of the hook. Each tongue 152, 156 has an arcuate outer edge 160. A spine 164 extends from the base 104 and along a substantial portion of the length of the outer surface 148 of the hook to stiffen the hook. The spine 164 connects to the base 104 at a point adjacent the front end of the base, such that a gap 168 (FIG. 4) is formed between the spine 164 and the hook 124 beneath the base 104. The spine 164 is generally planar when viewed from the front and is arcuate when viewed from the side, and the spine 164 extends generally perpendicular to the outer surface 148 of the hook. A web 172 is connected between the base 104 and the hook 124 to further stiffen the hook, the web bridging the gap 168 and extending generally perpendicular to the spine 164 and to the base 104 and generally parallel to the real edge 108 of the base. The hook 124 also has transverse stiffening ribs 176 that extend outward from and generally perpendicular to the spine 164 on the outer surface 148 of the hook. The ends of the ribs 176 can function as ejector pads 180 in the injection molding process. The hook 124 is naturally biased to a normal position, shown in FIGS. 4 and 5, and the hook is able to flex such that the opening 140 of the intermediate section can expand.

Figure 6:
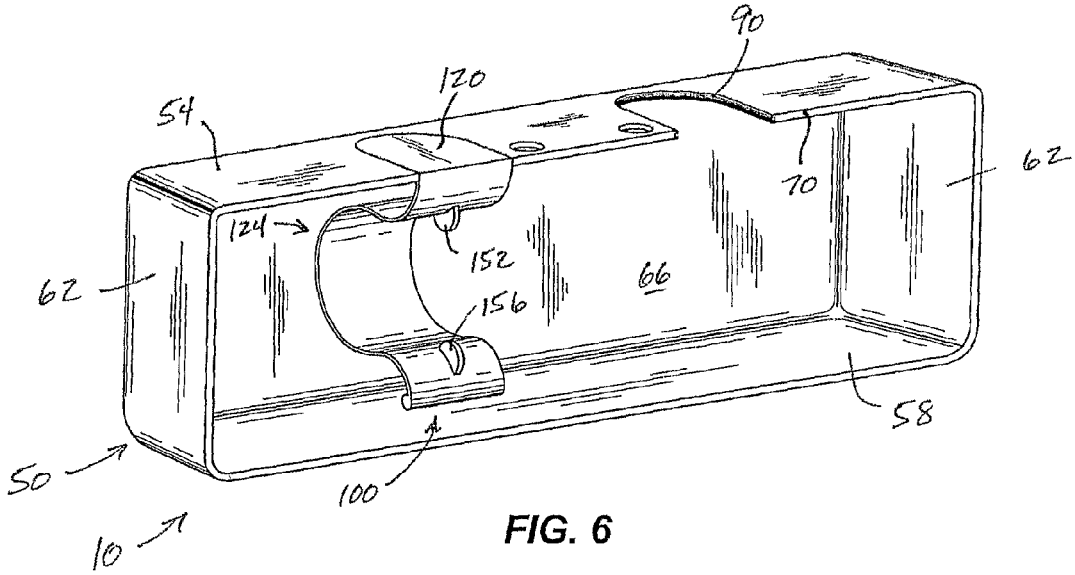
FIG. 6 is a perspective view of the cover with the clip inserted in a slot.
Figure 7:
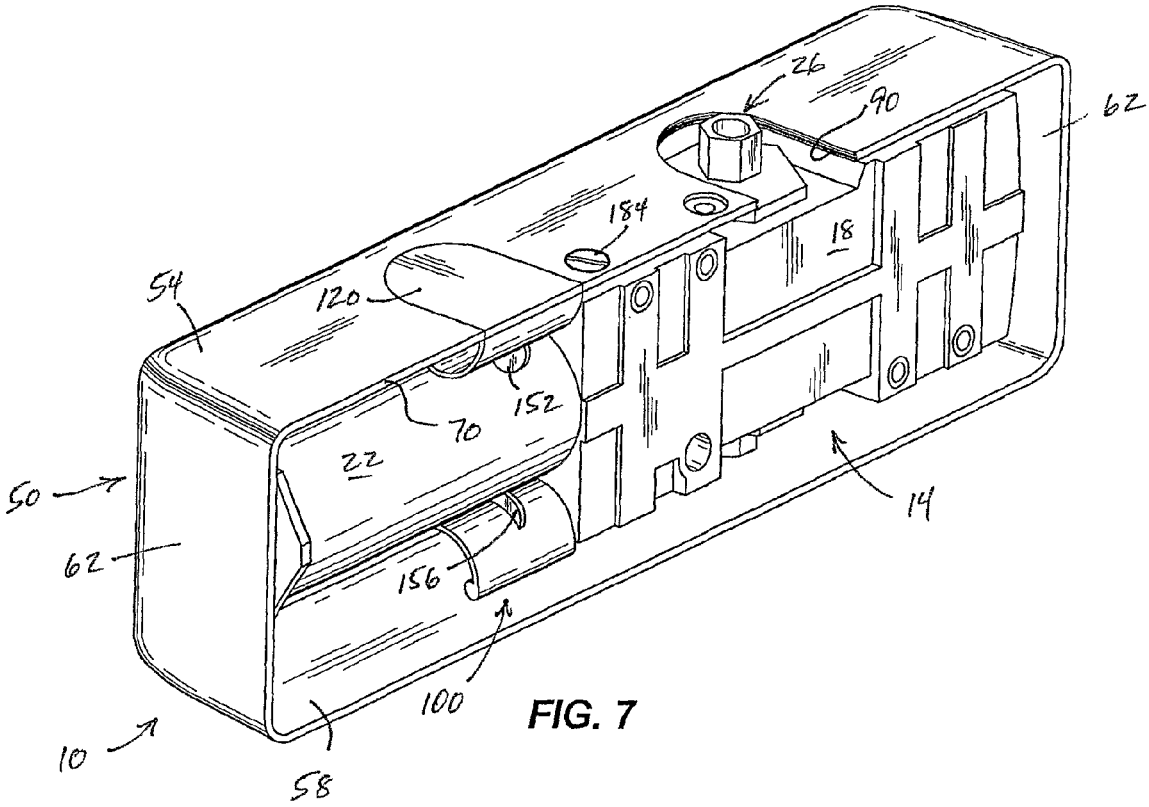
FIG. 7 is a rear perspective view of the cover, clip and door closer body of FIG. 2.

The base 104 of the clip 100 is insertable into either one of the slots 86, 90 so that the base substantially fills the slot and the upper surface 120 of the base is coplanar with the top wall 54. Interengagement of the ridge 116 and the groove 98, along with a tight fit between the base 104 and the top wall 54, hold the clip 100 in position relative to the housing 50 so that the clip 100 is secured to the top wall 54 of the housing 50 with the hook 124 positioned inside the housing and opening rearwardly, as shown in FIG. 6. The housing 50 with the clip 100 inserted into one of the slots 86, 90 is positionable over the door closer 14 with the hook 124 of the clip flexing to receive the spring tube 22 so that the tongues 152, 156 grip the spring tube under the influence of the hook's biasing force to removably secure the housing over the door closer. As the hook 124 is pushed over the spring tube 22, the outer surface of the spring tube cams against the arcuate outer edges 160 of the tongues 152, 156 to spread the opening 140. After the housing is over the cylinder body 18 with the hook 124 gripping the spring tube 22, a screw 184 (FIGS. 3 and 7) is inserted through the screw aperture 78, 82 nearest the clip 100 and is threaded into an aligned aperture 188 (FIG. 3) in the cylinder body 18 to further secure the housing 50 to the door closer 14.

When the door closer 14 is configured for left-handed operation, as shown in FIG. 1, the clip 100 is inserted in the left slot 90 and the housing 50 is positioned over the door closer 14 so that the pinion shaft 26 extends through the right slot 86. The clip 100 grips the spring cylinder 22 as described above. Also, the screw 184 is inserted into the left screw aperture 82.

When the door closer 14 is configured for right-handed operation, as shown in FIG. 2, the clip 100 is inserted in the right slot 86 and the housing 50 is positioned over the door closer 14 so that the pinion shaft 26 extends through the left slot 90. The clip 100 grips the spring cylinder as described above. Also, the screw 184 is inserted into the right screw aperture 78.

If desired, a plug (not shown) can be placed in the unused screw aperture.

Various features and advantages of the invention are set forth in the following claims.

What is claimed is:

1. A cover for either a left-handed or right-handed operating automatic door closer including a body, and a pinion shaft extending from the top of the body, the cover comprising:

a housing including a wall and an open rear, the wall having a rear edge and having therein first and second slots, each of the slots extending forward from the rear edge; and a clip including a base complementary to each of the first and second slots, and a flexible hook including a first end connected to the base and a floating second end, the base of the clip being insertable into either one of the slots so that the base substantially fills the one of the slots and the clip is secured to the wall of the housing with the hook positioned inside the housing and opening rearwardly;

the housing with the clip inserted into one of the slots being positionable over the door closer with the hook of the clip receiving the door closer;

wherein, when the housing is positioned over the door closer, the pinion shalt extends through the first slot and the clip is inserted in the second slot when the door closer is configured for left-handed operation, and the pinion shaft extends through the second slot and the clip is inserted in the first slot when the door closer is configured for right-handed operation.

2. The cover of claim 1 wherein the wall has a front-to-rear centerline and is generally symmetrical about the centerline, and wherein the first and second slots are respectively located on opposite first and second sides of the centerline.

3. The cover of claim 1 wherein each of the slots is generally U-shaped, and wherein the base of the clip is generally U-shaped.

4. The cover of claim 1 wherein the wall has a front-to-rear centerline and is generally symmetrical about the centerline, and wherein the wall has therein first and second screw apertures respectively located on opposite first and second sides of the centerline, wherein the cover further comprises a screw configured to extend through one of the screw apertures to secure the housing to the door closer, and wherein, when the housing is positioned over the door closer, the screw is inserted into the first screw aperture when the clip is inserted into the first slot, and the screw is inserted into the second screw aperture when the clip is inserted into the second slot.

5. The cover of claim 4 wherein the first and second slots are respectively located on the first and second sides of the centerline.

6. The cover of claim 5 wherein the screw apertures are located inside of the slots relative to the centerline.

7. The cover of claim 6 wherein each of the slots is generally U-shaped, and wherein the base of the clip is generally U-shaped.

8. The cover of claim 7 wherein each of the slots has a perimeter defined by a surface of the wall having therein a single groove extending along the perimeter of the slot, and wherein the base has a perimeter and includes a protrusion extending along the perimeter of the base and configured to mate with the groove of a slot into which the base is inserted.

9. The cover of claim 8 wherein the hook includes a first end connected to the base and a floating second end.

10. The cover of claim 9 wherein the first end of the hook is connected to the rear end of the base, the hook includes a generally C-shaped intermediate section between the ends of the hook, the intermediate section having an opening, tongues extending inward from the intermediate section of the hook adjacent the first and second ends of the hook, a spine extending from the base and along a substantial portion of the length of the hook to stiffen the hook, and a web connected between the base and the hook to further stiffen the hook, the web extending generally perpendicular to the spine and generally parallel to the rear edge of the base, the hook being naturally biased to a normal position, and the hook being able to flex such that the opening of the intermediate section can expand, wherein the housing is positionable over the door closer with the hook of the clip flexing to receive the door closer so that the tongues grip the door closer under the influence of the hook's biasing force to removably secure the housing over the door closer.

11. The cover of claim 10 wherein the wall is the top wall of the housing.

12. The cover of claim 11 wherein the housing is generally rectangular, wherein the top wall is generally planar, and wherein the housing also includes generally planar bottom, opposite end and front walls, the top and bottom walls being generally parallel, the opposite end walls extending between the top and bottom walls and being generally parallel, and the front wall extending between the top and bottom walls and between the end walls.

13. The cover of claim 10 wherein the door closer has a spring cylinder having an outer diameter, and wherein the hook receives the spring cylinder and has a ribbon-like configuration with a rearwardly facing inner surface and a forwardly facing outer surface, the inner surface of the intermediate section generally forming a portion of a cylinder and having a diameter approximately equal to the outer diameter of the spring cylinder.

14. The cover of claim 13 wherein the tongues are generally planar and extend generally perpendicular to the inner surface of the hook, each tongue having an arcuate outer edge that cams against the spring cylinder when the hook receives the spring cylinder.

15. The cover of claim 13 wherein the spine connects to the base at a point spaced from the point where the hook connects to the base, such that a gap is formed between the spine and the hook adjacent the base, and wherein the web bridges the gap.

16. The cover of claim 13 wherein the hook also has transverse stiffening ribs that extend outward from and generally perpendicular to the spine on the outer surface of the hook, the ribs having ends that function as ejector pads.

17. The cover of claim 1 wherein each of the slots has a perimeter defined by a surface of the wall having therein a single groove extending along the perimeter of the slot, and wherein the base has a perimeter and includes a protrusion extending along the perimeter of the base and configured to mate with the groove of a slot into which the base is inserted.

18. The cover of claim 1 wherein the hook includes a first end connected to the rear end of the base and a floating second end, the hook includes a generally C-shaped intermediate section between the ends of the hook, the intermediate section having an opening, tongues extending inward from the intermediate section of the hook adjacent the first and second ends of the hook, a spine extending from the base and along a substantial portion of the length of the hook to stiffen the hook, and a web connected between the base and the hook to further stiffen the hook, the web extending generally perpendicular to the spine and generally parallel to the rear edge of the base, the hook being naturally biased to a normal position, and the hook being able to flex such that the opening of the intermediate section can expand, wherein the housing is positionable over the door closer with the hook of the clip flexing to receive the door closer so that the tongues grip the door closer under the influence of the hook's biasing force to removably secure the housing over the door closer.

19. The cover of claim 1 wherein the hook includes a first end connected to the base and a floating second end.

20. The cover of claim 1 wherein the wall is the top wall of the housing.

21. The cover of claim 1 wherein the housing is generally rectangular, wherein the top wall is generally planar, and wherein the housing also includes generally planar bottom, opposite end and front walls, the top and bottom walls being generally parallel, the opposite end walls extending between the top and bottom walls and being generally parallel, and the front wall extending between the top and bottom walls and between the end walls.

22. A cover for an automatic door closer including a body, a pinion shaft extending from both a top surface and a bottom surface of the body to accommodate left-handed or right-handed operation, and a cylindrical spring tube extending from the body, the cover comprising:

a generally rectangular housing including generally planar top, bottom, opposite end and front walls and an open rear, the top and bottom walls being generally parallel, the opposite end walls extending between the top and bottom walls and being generally parallel, and the front wall extending between the top and bottom walls and between the end walls, the top wall having a rear edge and a front-to-rear centerline and being generally symmetrical about the centerline, the top wall having therein first and second screw apertures respectively located on opposite first and second sides of the centerline, and the top wall having therein first and second slots respectively located on the first and second sides of the centerline and outside of the screw apertures relative to the centerline, each of the slots being generally U-shaped and extending forward from the rear edge, and each of the slots having a perimeter defined by a surface of the top wall having therein a single groove extending along the perimeter of the slot;

a unitary clip including a generally planar, generally U-shaped base complementary to each of the first and second slots, the base having a rear and a perimeter and including a protrusion extending along the perimeter of the base and configured to mate with the groove of a slot into which the base is inserted;

a flexible hook including a first end connected to the rear end of the base and a floating second end, the hook including a generally C-shaped intermediate section between the ends of the hook, the intermediate section having an opening;

tongues extending inward from the intermediate section of the hook adjacent the first and second ends of the hook;

a spine extending from the base and along a substantial portion of the length of the hook to stiffen the hook; and a web connected between the base and the hook to further stiffen the hook, the web extending generally perpendicular to the spine and generally parallel to the rear edge of the base;

the hook being naturally biased to a normal position, and the hook being able to flex such that the opening of the intermediate section can expand;

the base of the clip being insertable into either one of the slots so that the base substantially fills the slot and the clip is secured to the top wall of the housing with the hook positioned inside the housing and opening rearwardly;

the housing with the clip inserted into one of the slots being positionable over the door closer with the hook of the clip flexing to receive the spring tube so that the tongues grip the spring tube under the influence of the hook's biasing force to removably secure the housing over the door closer; and a screw configured to extend through one of the screw apertures to secure the housing to the door closer; and wherein, when the housing is positioned over the door closer, the pinion shaft extends through the first slot and the clip is inserted in the second slot when the door closer is configured for left-handed operation, and the pinion shaft extends through the second slot and the clip is inserted in the first slot when the door closer is configured for right-handed operation; and wherein, when the housing is positioned over the door closer, the screw is inserted into the first screw aperture when the clip is inserted into the first slot, and the screw is inserted into the second screw aperture when the clip is inserted into the second slot.

23. A method of covering either a left-handed or right-handed operating automatic door closer including a body, and a pinion shaft extending from the top of the body, the method comprising:

providing a cover housing including a wall and an open rear, the wall having a rear edge and halving therein first and second slots, each of the slots extending forward from the rear edge;

providing a clip including a base complementary to each of the first and second slots, and a flexible hook including connected to the base;

inserting the base of the clip into the second slot if the door closer is configured for left-handed operation, so that the base substantially fills the second slot and the clip is secured to the wall of the housing with the hook positioned inside the housing and opening rearwardly; and after inserting the base of the clip into the second slot, placing the cover housing over the door closer so that the pinion shaft extends through the first slot and the hook of the clip grips the door closer; or inserting the base of the clip into the first slot if the door closer is configured for right-handed operation, so that the base substantially fills the first slot and the clip is secured to the wall of the housing with the hook positioned inside the housing and opening rearwardly; and after inserting the base of the clip into the first slot, placing the cover housing over the door closer so that the pinion shaft extends through the second slot and the hook of the clip grips the door closer.

24. The cover of claim 23 wherein providing a cover housing includes providing the wall with first and second screw apertures, wherein the method further comprises securing the housing to the door closer by inserting a screw into the first screw aperture when the clip is inserted into the first slot, and inserting a screw into the second screw aperture when the clip is inserted into the second slot.

* * * * *